United States Patent [19]

Grill

[11] Patent Number: 4,506,527

[45] Date of Patent: Mar. 26, 1985

[54] VEHICLE DOOR LOCK ASSEMBLY

[76] Inventor: Milton D. Grill, 9815 NW. 65th Ct., Tamarac, Fla. 33321

[21] Appl. No.: 481,803

[22] Filed: Apr. 4, 1983

[51] Int. Cl.[3] ..... E05B 73/00; E05C 19/18

[52] U.S. Cl. ..... 70/14; 70/101; 292/295

[58] Field of Search ..... 70/14, 91, 101; 134, 70/237; 292/295, 288, 289, 292, 296

[56] References Cited

U.S. PATENT DOCUMENTS

| | | | |
|---|---|---|---|
| 2,055,907 | 9/1936 | Menchen | 70/14 |
| 3,181,319 | 5/1965 | Hudon | 70/14 |
| 4,059,299 | 11/1977 | Huntley | 292/294 |
| 4,399,672 | 8/1983 | Moorhouse | 70/101 |

*Primary Examiner*—Robert L. Wolfe

*Attorney, Agent, or Firm*—Oltman and Flynn

[57] ABSTRACT

This door lock assembly has a thin mounting plate which fits snugly against the door post and passes behind the rear edge of the door without interfering with the usual latch on the door. An opening in this mounting plate passes the usual striker on the door post for engagement by the door latch. The mounting plate has an outer wall segment which extends behind the rear edge of the door and supports the housing of a lock. The lock has a slidable locking bolt which can be retracted behind the rear edge of the door, permitting the door to be opened and closed, or extended forward along the outside of the door to lock it closed.

9 Claims, 6 Drawing Figures

FIG. 1
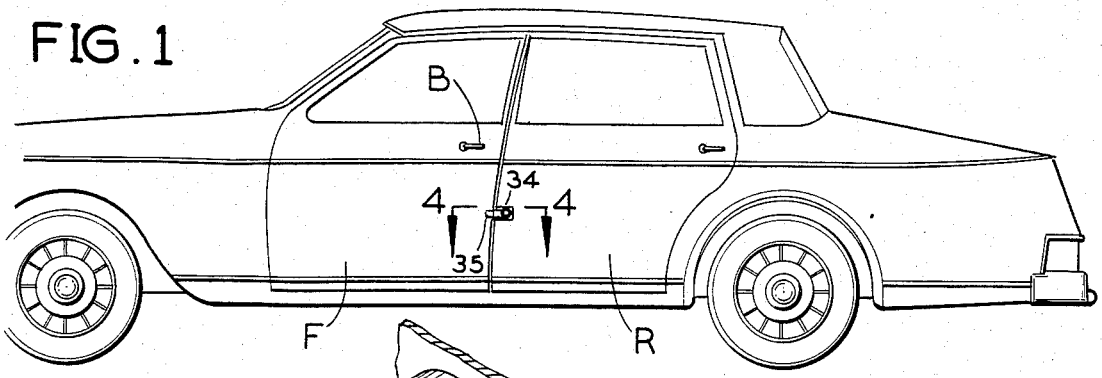
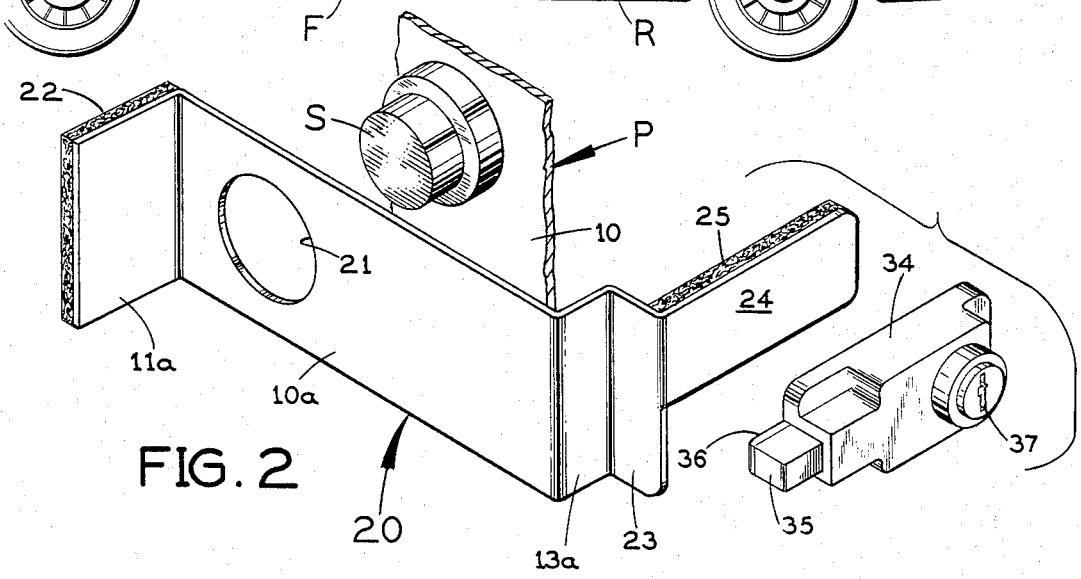
FIG. 2
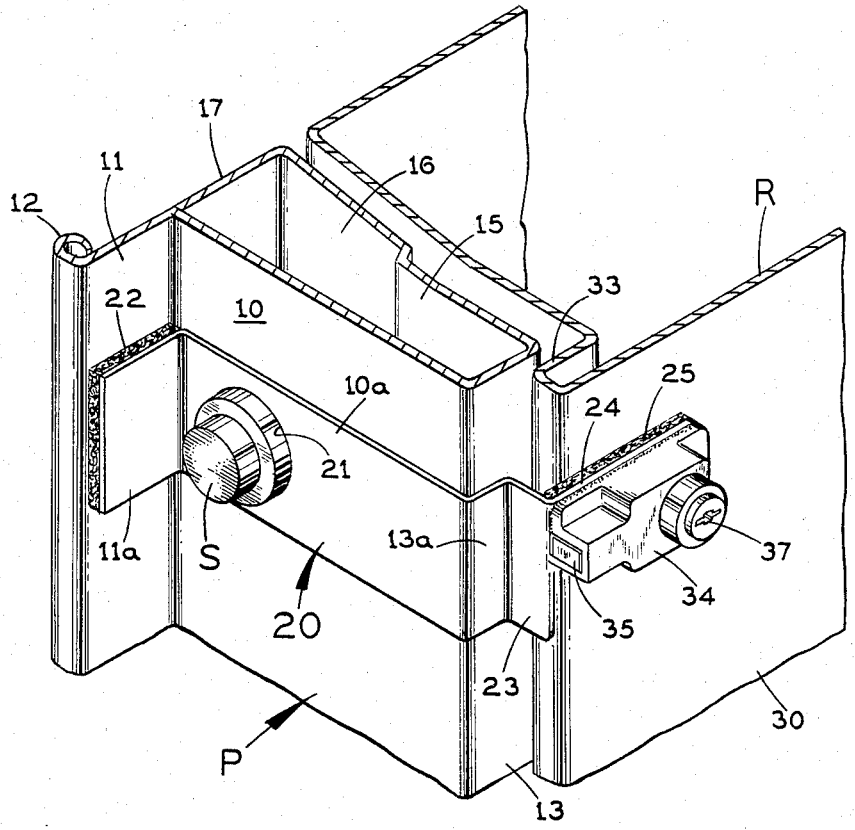
FIG. 3

VEHICLE DOOR LOCK ASSEMBLY

SUMMARY OF THE INVENTION

This invention relates to a lock assembly for temporary attachment to an automotive vehicle to prevent unauthorized opening of one door or the front and rear doors on one side of a car.

In accordance with the presently preferred embodiments of this invention, a door lock assembly is provided which has a mounting plate for snug engagement with the usual door post behind the front door of the vehicle, with an opening in this mounting plate receiving the usual striker on this post to position the mounting plate properly on the door post without interfering with the usual latch and door lock on this door. The mounting plate extends laterally outward behind the rear edge of the front door and has an outer wall which extends snugly across the car body or the front edge of the rear door immediately behind the front door post. A lock has its housing mounted on this outer wall of the mounting plate and slidably receiving a locking bolt which may be extended to a locking position projecting forward across the outside of the front door in front of its rear edge to prevent this door from being opened.

Whenever the driver parks the car, after opening the front door he or she may mount the mounting plate of the lock assembly on the door post and, with the locking bolt retracted, the front door may be closed, leaving the mounting plate in place on the door post. Then the driver may operate the lock on the mounting plate to slide the locking bolt forward to its locking position along the outside of the front door in front of its rear edge. This procedure is reversed when the driver wants to enter the parked car.

With this arrangement the usual door latch and lock on the front door remains intact and able to function as intended. However, a thief cannot enter the car simply by disabling this usual door lock but he must also disable the present door lock. Moreover, if a thief succeeds in entering the car another way, the present lock assembly will be visible on the outside of the car, thereby notifying any observer that an unauthorized person is driving the car.

The present lock assembly can be applied while the driver remains in the car. This is advantageous if the car breaks down in a place where the driver would not feel safe to leave the car.

A principal object of this invention is to provide a novel vehicle door lock assembly which the driver readily can put in its door-locking position or remove from that position just as readily.

Another object of this invention is to provide a novel vehicle door lock assembly which is adapted for mounting on the door post behind a door of the vehicle.

Another object of this invention is to provide a novel lock assembly which can be installed and locked by a person remaining in the vehicle.

Further objects and advantages of this invention will be apparent from the following detailed description of three presently preferred embodiments which are illustrated schematically in the accompanying drawings.

DESCRIPTION OF THE DRAWINGS

FIG. 1 is a side elevational view of a four-door car equipped with a door lock assembly in accordance with a first embodiment of the present invention;

FIG. 2 is an exploded perspective view showing the door lock assembly in FIG. 1 and the striker on the front door post of the car;

FIG. 3 is a fragmentary perspective view showing this lock assembly in place on the door post;

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION

Figure 4:
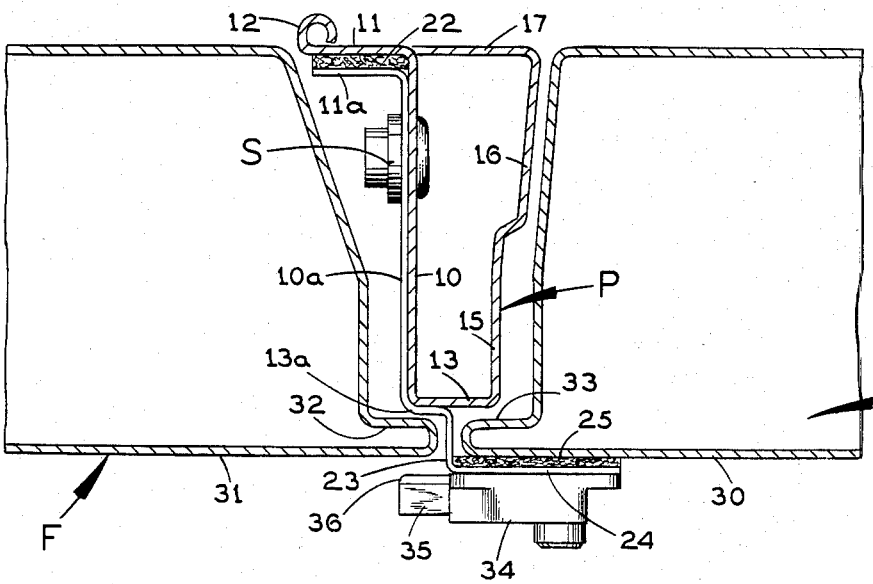
FIG. 4 is a horizontal section taken along the line 4—4 in FIG. 1, showing the door lock assembly in its door-locking position.

Referring first to FIGS. 3 and 4, the lock assembly of the present invention is shown mounted on the front of the usual door post P which extends up at the rear of the front door opening in a passenger car. As shown in FIG. 4, on a four door car this door post extends up laterally inward from the rear edge of the front door F and the front edge of the rear door R. The front door is hinged at the front and its rear edge is movable toward the post P when the door is to be closed and away from it to open the door.

The door post P is of hollow construction, presenting a front wall 10 which extends laterally outward perpendicular to a flat inner wall 11, which extends forward from wall 10 to a rearwardly and inwardly bent front edge at 12 extending up next to the back rest of the front seat of the car. At the outer edge of its front wall 10 the door post is formed with a right-angled, rounded corner connecting it to a rearwardly extending outer wall 13. The outer wall 13 is positioned laterally inward from the outside wall 30 of the rear door R and the outside wall 31 of the front door F, as best seen in FIG. 4. At the rear edge of its outer wall 13 the door post is formed with a right-angled rounded corner connecting it to a laterally inwardly extending back wall segment 15. About half-way across the lateral extent of the door post P its back wall segment 15 is connected to a rearwardly-offset, inwardly extending back wall segment 16. At the inner edge of back wall segment 16 an inner wall 17 of the door post extends forward to the right-angled rounded corner between its front wall 10 and its inner wall 11.

A striker S is mounted on the front wall 10 of the door post, projecting horizontally forward from it and presenting a cylindrical enlargement next to the front wall 10. This striker cooperates with a latch of known design on the front door F, which is operated by a push-button B (FIG. 1) on the outside handle of the front door and by a pivoted handle (not shown) on the inside of the front door. This latch is engageable with the striker S to hold the front door closed. The usual lock for the front door has a keyhole slot in the push button B.

The door lock assembly of the present invention comprises a thin mounting plate 20 (FIG. 2) which is shaped and dimensioned to fit snugly on the door post P. Elements of this mounting plate which fit against or close to elements of the door post are given the same reference numeral plus an "a" suffix.

The mounting plate 20 has a flat front wall segment 10*a* with a circular opening 21 which is slidably insertable over the enlarged back end of the striker S on the door post so that the front wall segment 10*a* of the mounting plate can be flush against the front wall 10 of the door post, as shown in FIGS. 3 and 4. The mounting plate has an inner wall 11*a* extending perpendicularly forward from the inner edge of its front wall 10*a* and carrying a soft resilient pad or cushion 22 on its inner face for engagement with the inner wall 11 of the door post. The mounting plate has a wall segment 13*a* extending rearward from the outer edge of its front wall 10*a* and extending closely across the outer wall 13 of the door post for about half the latter's extent from front to back on the car. The mounting plate has a wall segment 23 extending laterally outward from the rear edge of wall segment 13*a*. The wall segments 13*a* and 23 together define a corner wall means which forms a right-angled, front outer corner on the mounting plate. The mounting plate has a flat outer wall segment 24 which is joined to the wall segment 23 at the latter's outer edge and extends perpendicular to it across the outer wall 30 of the rear door R for a short distance behind the latter's front edge. This outer wall segment 24 of the mounting plate carries a soft resilient pad or cushion 25 on its inside face for engagement with the outside of the rear door.

As shown in FIG. 4, the outer wall 31 of the front door F is reversely bent along its rear edge so that it presents an inwardly-facing lip 32 which is received in the outer front corner of the mounting plate formed by its wall segments 13*a* and 23. When the door is closed there is enough clearance between this door lip 32 and the outer wall 13 of the door post to permit the wall segment 13*a* of the mounting plate 20 to pass between them as shown in FIG. 4.

The outer wall 30 of the rear door is reversely bent along its front edge so that it presents an inwardly-facing lip 33 (FIG. 4) which is spaced laterally outward from the outer wall 13 of the door post.

There is enough clearance between the rear edge of the front door and the front edge of the rear door to permit the wall segment 23 of the mounting plate to pass between them when both doors are closed, as shown in FIG. 4.

Referring to FIG. 2, a deadbolt lock of known design has a rigid housing 34 which is welded to the outside of the outer wall 24 of the mounting plate, as shown in FIGS. 3 and 4. The front edge of the lock housing is substantially even with the front face of wall segment 23 of mounting plate 20. The lock housing 34 receives a locking bolt 35 which is horizontally slidable between a fully retracted position (FIG. 3) in which it is completely within the housing 34 and an extended position (FIGS. 2 and 4) in which it projects forward across the outside of the front door adjacent its rear edge and prevents this door from being opened more than a fraction of an inch. The lock bolt 35 carries a soft pad or cushion 36 on its inside face to prevent scratching the front door. The lock bolt is operated by a key inserted in the lock cylinder at 37.

As shown in FIG. 4, when the lock bolt 35 is in its extended position it permits the front door F to be opened only a fraction of an inch. Also, the rear door R can be opened only slightly because the padded outer wall 24 of the mounting plate extends snugly across the outside of this door near its front edge.

The present lock assembly may be mounted on the door post by the driver when he or she parks the car in a place where it might be stolen.

With the rear door closed and the front door at least part way open, and the lock bolt 35 retracted, the driver simply slides the mounting plate 20 over the keeper S on the door post to position the front wall 10*a* of the mounting plate 10*a* against the front wall 10 of the door post. The padded inner wall 11*a* of the mounting plate engages the inner wall 11 of the door post, wall segment 13*a* of the mounting plate engages the outer wall 13 of the door post, and the padded outer wall segment 24 of the mounting plate engages the outside of the rear door. Consequently, the mounting plate fits snugly on the door post and the rear door in the position shown in FIG. 3. Then, after the front door is closed, by inserting a key the driver can slide the deadbolt 35 forward to the locking position (FIG. 4), preventing the front door from being opened by a thief. Also, the mounting plate and the lock housing are positioned to prevent the rear door from being opened.

Even if a thief manages to enter the car at some other entry point than the doors where the present lock assembly is in place, the lock 34, 35 will be visible on the outside of the car and this will notify an alert observer, such as a police officer, that an unauthorized person is driving the car.

The present lock assembly can be installed by a driver who remains in the car. The driver can open the front door enough to position the mounting plate 20 on the door post, as described. After closing the front door, the driver can reach out the window and insert a key in the keyhole 37 to slide the locking bolt 35 forward to the extended position in which it locks the front door closed. After closing the window the driver is locked in the car and safe from anyone outside and can turn on the vehicle's flasher to signal for help. This is particularly advantageous for a driver in a disabled vehicle in an area where he or she might not feel safe to leave the car.

It is to be understood that the lock may differ from the particular deadbolt lock shown at 34,35 in FIGS. 2–4. It may be a combination lock instead of a key-operated lock, if desired.

Figure 5:
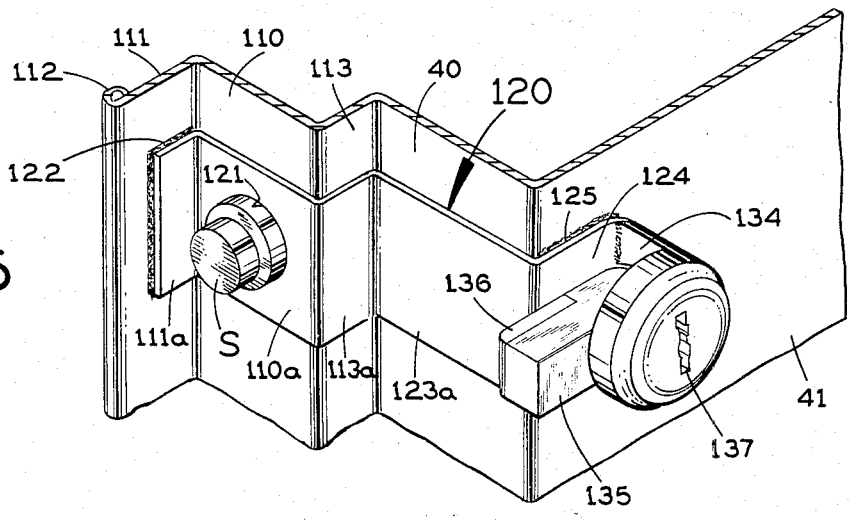
FIG. 5 is a perspective view of a second embodiment of the present door lock assembly for use on a two-door car, in this case a 1978 Ford Fairmont.

FIG. 5 shows a second embodiment of the present door lock assembly mounted on a two-door 1978 Ford Fairmont which has a different cross-sectional shape at the door post behind the front door. For the sake of simplicity, only the exposed faces of the car body at this door post are shown although it is to be understood that the post has a suitable reinforcing structure. Elements of this embodiment are given the same reference numerals plus 100 as those in the embodiment of FIGS. 1–4, so that a detailed description of these elements is not necessary.

In FIG. 5, the wall segment 113 of the door post is connected at a right-angled rounded corner to a laterally outwardly extending wall segment 40 of the car body. The outer edge of wall segment 40 is connected at a right-angled rounded corner to an outer wall 41 of the car body which extends rearward from the front door substantially coplanar with its outer wall.

The mounting plate of the present lock assembly is shaped to fit snugly on the car body, with the opening 121 in the mounting plate snugly receiving the enlarged back end of the striker S, the padded inner wall 111*a* of the mounting plate engaging the inner wall 111 of the door post, the wall segment 113*a* of the mounting plate engaging the wall segment 113 of the door post, the wall segment 123*a* of the mounting plate against the front of wall segment 40 of the car body, and the padded outer wall 124 of the mounting plate against the outer wall 41 of the car body.

The rear edge of the front door fits in the outer front corner formed by wall segments 113*a* and 123*a* of the mounting plate and when the front door is closed its outside surface is substantially flush with the rear wall 41 of the car body.

When the locking bolt 135 is retracted, its front edge is substantially even with the wall segment 40 of the car body. After mounting the mounting plate of the lock assembly in place, as shown in FIG. 5, and with the locking bolt 135 retracted, the front door may be closed. Then a key is inserted in the slot 137 and turned to slide the locking bolt 135 forward to its extended position in which it extends closely across the outside of the front door just forward from its rear edge.

Figure 6:
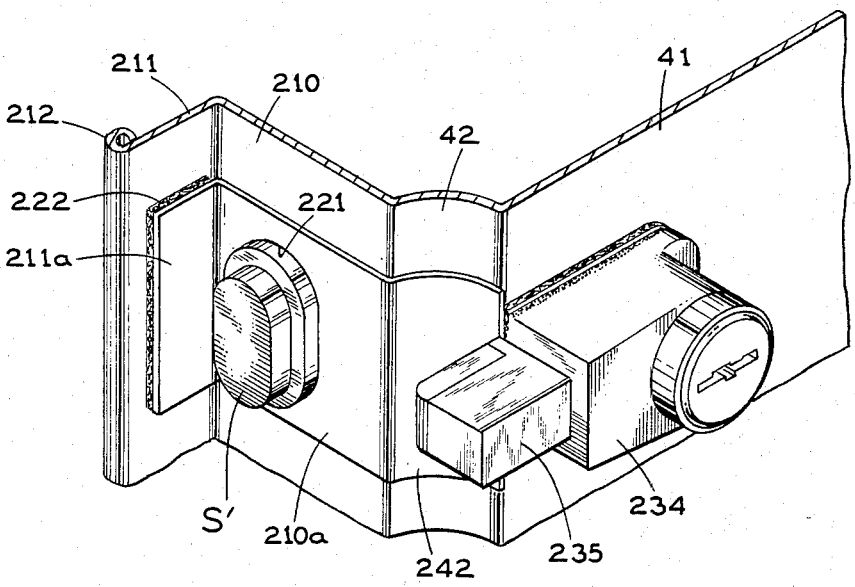
FIG. 6 is a view similar to FIG. 5 and showing a third embodiment, also for use on a two-door car, in this case a 1980 Toyota Celica.

FIG. 6 shows a third embodiment of the present door lock assembly mounted on a two-door Toyota Celica, which has a different cross-sectional shape at the door post than either of the first two embodiments. Here again, only the exterior of the car body at the door post is shown, the reinforcing structure being omitted for simplicity. Elements of the FIG. 6 embodiment have the same reference numerals plus 200 as the elements in the embodiment of FIGS. 1–4. The striker S' on this door post is oblong instead of circular in cross-section so the opening 221 in the front wall in the mounting plate of the lock assembly also is oblong. The outside front corner of the door post is of rounded concave configuration extending through an arc of 90 degrees, as shown at 42, and the outside front corner of the mounting plate has a similar configuration, as shown at 242. In other respects the lock assembly of FIG. 6 is essentially similar to the first two embodiments of this invention.

From the foregoing description and the accompanying drawings it will be evident that the present lock assembly may be carried in the car or other automotive vehicle for use whenever the driver thinks it advisable. The mounting plate of this lock assembly can be readily mounted on the door post and just as readily removed from it. For complete security, the car or other vehicle would have one of these lock assemblies on each side to prevent unauthorized opening of the door or doors on that side. If desired, the mounting plate of this lock assembly could be designed to fit on the door post behind a rear door of the vehicle to coact with that door in essentially the same way as described in detail herein for a front door of the vehicle.

I claim:

1. A unitary door lock assembly for removable attachment to an automotive vehicle having a body with a door opening, a front-hinged door for closing said door opening, an upwardly extending door post at the rear of said door opening, and a striker extending forward from said door post for coaction with a latch on said door when the latter is closed, said lock assembly comprising:

a thin mounting plate shaped and dimensioned to fit in front of the door post and pass laterally outward behind the rear edge of the door, said mounting plate having an opening therein for passing said striker when the mounting plate is placed against the front of the door post, said mounting plate having an outer wall segment positioned to extend rearward from said door post across the outside of the car behind said door;

and a lock on said outer wall segment of the mounting plate having a locking element which is extensible forwardly along the outside of said door to lock the latter closed and is retractable rearwardly to a position completely behind the rear edge of said door to permit the latter to be opened and closed.

2. A lock assembly according to claim 1, wherein said mounting plate has:

a generally flat front wall segment having said opening therein and extending laterally inward from and substantially perpendicular to said outer wall segment;

and corner wall means extending from the outer edge of said front wall segment through substantially 90° to the front edge of said outer wall segment and defining a front outer corner on the mounting plate which receives the rear edge of said door when the latter is closed.

3. A lock assembly according to claim 2, wherein said mounting plate has:

an inner wall segment extending forward from the inner edge of said front wall segment substantially perpendicular thereto for engagement with a corresponding wall of the door post.

4. A lock assembly according to claim 3, and further comprising:

a soft pad on the inner face of said outer wall segment of the mounting plate for engagement with the outside of the car behind said door;

and a soft pad on the inner face of said inner wall segment for engagement with said corresponding wall of the door post.

5. A lock assembly according to claim 1, wherein said mounting plate has:

a forwardly extending inner wall segment for engagement with a corresponding wall of the door post.

6. A unitary door lock assembly for removable attachment to an automotive vehicle having:

a body with a door opening;

a front-hinged door for closing said opening;

an upwardly-extending door post at the rear of said door opening having a generally flat front wall, an inner wall extending forward from the laterally inward edge of said front wall substantially perpendicular to said front wall, and an outer wall extending rearward from said front wall substantially perpendicular to the latter;

and a striker on said door post projecting forward from its front wall;

said lock assembly comprising:

a thin mounting plate shaped and dimensioned to fit snugly on said door post, said mounting plate having a generally flat front wall segment with an opening which passes said striker and enables said front wall segment to extend closely in front of said front wall of the door post, an inner wall segment extending forward from the laterally inward edge of said front wall segment perpendicular to said front wall segment to extend closely outside said inner wall of the door post when said front wall segment of the mounting plate extends closely in front of said front wall of the door post, outer front corner wall means extending rearward and laterally outward through substantially 90° from the laterally outward edge of said front wall segment and shaped and dimensioned to receive the rear edge of said door when the latter is closed, and an outer wall segment extending rearward from the outer edge of said outer front corner wall means of the mounting plate to extend closely across the outside of the car behind said door;

and a lock having a housing mounted on said outer wall segment of the mounting plate and a locking element slidably received in said housing, said locking element being retractable rearwardly into the housing to a position behind the rear edge of said door when the latter is closed, whereby to permit the latter to be opened and closed, and being extensible forwardly along the outside of the door to lock the latter closed.

7. A door lock assembly according to claim 6, wherein each of said inner and outer wall segments of the mounting plate has a cushioning pad on its inner face.

8. A door lock assembly according to claim 6, wherein said outer front corner wall means on the mounting plate forms a right-angled corner.

9. A door lock assembly according to claim 6, wherein said outer front corner wall means on the mounting plate forms a substantially continuously curved concave corner.

* * * * *